United States Patent [19]

Bertoglio

[11] 4,186,990

[45] Feb. 5, 1980

[54] LEAD SOCKET INSERT

[75] Inventor: Guido Bertoglio, Viganello, Switzerland

[73] Assignee: Augat Inc., Attleboro, Mass.

[21] Appl. No.: 926,227

[22] Filed: Jul. 19, 1978

[51] Int. Cl.² ..... H01R 13/12

[52] U.S. Cl. ..... 339/258 R; 339/262 R

[58] Field of Search ..... 339/256 R, 258 R, 258 A, 339/258 RR, 258 P, 262 R, 262 RR, 275 B, 276 A

[56] References Cited

U.S. PATENT DOCUMENTS

| | | | |
|---|---|---|---|
| 3,784,965 | 1/1974 | Murphy | 339/262 R |
| 4,050,772 | 9/1977 | Birnholz et al. | 339/258 R |
| 4,097,101 | 6/1978 | Holt et al. | 339/258 R |

*Primary Examiner*—Joseph H. McGlynn

[57] ABSTRACT

An improved lead socket insert for mounting to an electrical interconnection panel board, the insert being adapted to pluggably receive a lead of a circuit component such as an integrated circuit package. The insert has converging flexible fingers with improved operational characteristics which positively engage the component lead in a frictional manner when the lead is inserted between the converging fingers. The invention is also concerned with the method for constructing the lead socket insert. The insert may be employed directly in panel boards to pluggably receive component leads, or as the insert in a contact sleeve forming a two-piece socket contact.

15 Claims, 11 Drawing Figures

LEAD SOCKET INSERT

FIELD OF THE INVENTION

This invention relates generally to electrical interconnection apparatus and more particularly concerns an improved lead socket insert for pluggably interconnecting leads of circuit components to an electrical interconnection panel board.

DISCUSSION OF THE PRIOR ART

Socket contacts of the type to which this invention relates have been widely used in industry for the purpose of pluggably receiving the leads of electronic components wherein the contacts are mounted to an electrical interconnection panel board. Socket contacts of the type under consideration are of the combination sleeve and insert type where the sleeve normally has a hollow cylindrical body and a solid projection for interconnection to other circuit elements. An insert with converging fingers is force fitted into the body of the sleeve to form the composite socket contact. Machined prior art socket contacts have certain deficiencies due to the fact that the converging fingers of the socket insert are normally curved in a lateral direction with respect to their length. This creates an inherent beam effect in the fingers which cause stresses to occur primarily at the point on the insert body where the individual fingers of the insert are bent toward one another. Because of this beam configuration, the fingers are relatively stiff so that flexing occurs primarily at the bending point rather than being distributed throughout the length of the fingers when a lead is inserted between them. Because of the lateral curve and attendant stiffness, the fingers make substantially only point contact at their distal ends with an inserted circuit component lead of rectangular cross section. This creates potential problems in high reliability applications. The curved beam configuration of the fingers serves to reduce any flexibility of the fingers themselves except at the bend point. Also because of the relative stiffness of the fingers, electrical component lead insertion and removal forces tend to be inconsistent from insert to insert and over a period of time in the use of a lead socket insert.

The prior art also includes stamped and formed socket contacts and lead socket inserts. These devices have additional disadvantages over machined inserts of the type of the present invention. Because of the manner of making stamped inserts there are normally some areas which are not plated. Unplated socket parts are not acceptable for some applications because of corrosion which will occur in areas vital to the circuit (the contact itself, and the interconnection with a component lead, are vital parts of a circuit), so stamped contacts cannot be employed in these instances. Additionally, it is not reasonably possible to make stamped inserts perfectly round. They are substantially always somewhat egg-shaped, resulting in variable lead insertion and removal forces, and variability in physical and electrical contact. Further, no practical method has been devised to form a stamped insert with a tapered lead-in which is continuous, that is, does not form a step, with the sleeve lead-in. A smooth entry is desirable to facilitate insertion of a component lead. Also the butted edges of stamped contacts are often uneven and abrasive thereby scraping the metal plating on the inside of the contact sleeve or assembly.

While the prior art lead socket inserts serve useful functions, their limitations have prevented their universal use where they might otherwise be the appropriate structure for various applications.

SUMMARY OF THE INVENTION

One of the primary objects of this invention is to provide an improved lead socket insert having distributed flexibility throughout the length of the converging insert fingers thereby making improved electrical contact with the inserted component lead. Additionally the configuration of the insert of the invention provides stabilized insertion and removal forces of component leads.

The lead socket insert of this invention is formed from a piece of wire which is center bored to form a cylinder. Two parallel cuts are then made in a direction parallel to the cylinder axis, the outer extremity of each cut being tangential with the inner surface of the cylinder. Another pair of parallel cuts are made in the same manner, angularly spaced by 90° from the first pair of cuts, thereby providing four fingers extending from the body portion of the insert. When these fingers are bent inwardly to form a converging configuration for pluggably receiving component leads, each finger, having a flat inner surface, acts more as a leaf spring rather than as a curved beam. Thus when the component is inserted, thereby spreading the fingers to some extent, the flexibilty of each finger is distributed throughout its length thereby making not only point but in some cases surface contact with the inserted lead. This configuration substantially reduces the stresses at the bend point because of the flexing which takes place throughout the length of the fingers. Additionally, because the insert of the present invention is machined, the internal bore can be accurately linear, and of course, perfectly round.

If the cuts made in the insert have a width less than the thickness of the contact wall the fingers can be made somewhat wider. In an alternative embodiment, two further cuts are made on the 45° angles between the original cuts. These cuts bevel or chamfer the inner corners of each finger, allowing them to be biased closer together, thereby positively engaging very small component leads.

Another alternative embodiment requires only one wide axial cut through the insert, leaving two oppositely facing fingers which are then biased together.

BRIEF DESCRIPTION OF THE DRAWING

The objects, advantages and features of this invention will be more clearly appreciated from the following description when read in conjunction with the accompanying drawing in which.

DESCRIPTION OF THE PREFERRED EMBODIMENTS

Figure 1:
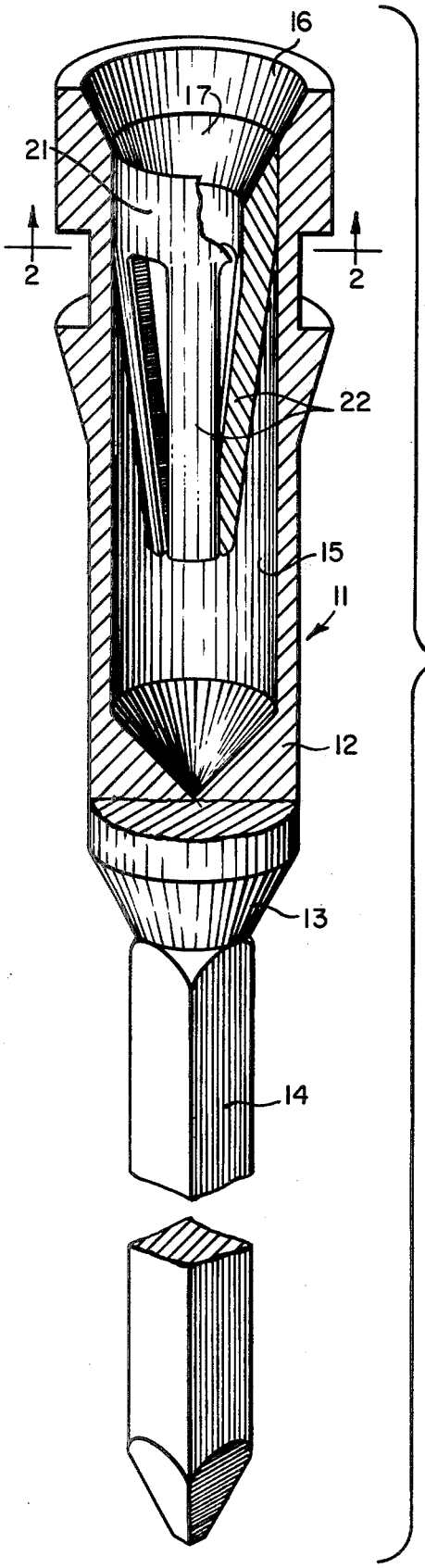
FIG. 1 is a vertical sectional view of a two-piece socket contact of the type of the present invention.

With reference now to FIG. 1 there is shown a typical two-piece socket contact 11, generally representative of both the present invention and the prior art, comprised of an outer sleeve 12 having transition bevel 13 to elongated wire wrapping pin 14. Pin 14 may equally be a cylindrical solder tail or other type of interconnection extension. The interior bore 15 of sleeve 12 has a tapered entry 16 which forms a continuation of tapered entry 17 of socket insert 21. Insert 21 is force fitted into bore 15 and is formed with converging flexible fingers 22 which are adapted to pluggably receive the leads of a circuit component and frictionally retain these leads due to the flexiblity and spring aspect of the fingers.

Figure 2:
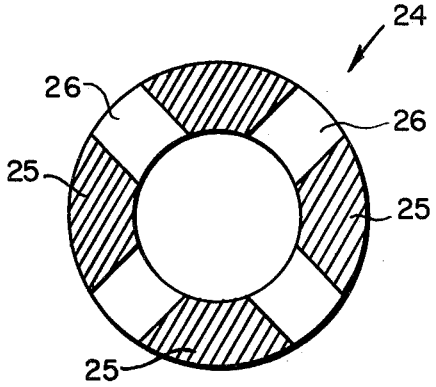
FIG. 2 PRIOR ART
FIG. 2 is a sectional view taken along cutting plane 2—2 of FIG. 1 showing the structure of the insert of a prior art socket contact.
Figure 3:
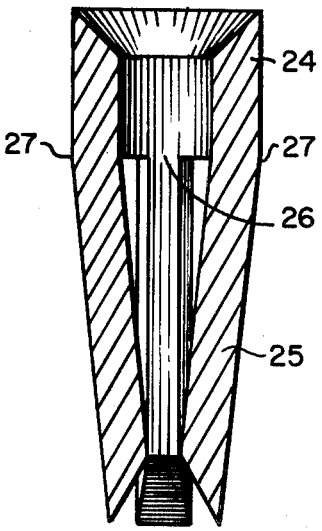
FIG. 3 PRIOR ART
FIG. 3 is a vertical sectional view showing the prior art insert of FIG. 2 before the insertion of a component lead.
Figure 4:
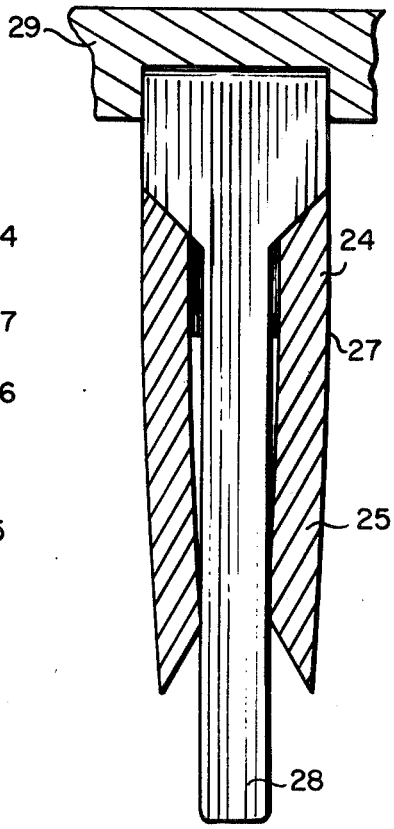
FIG. 4 PRIOR ART
FIG. 4 is a view similar to FIG. 3 with a component lead inserted.

The construction of a prior art device similar to insert 21 in FIG. 1 is shown in FIGS. 2, 3 and 4. This insert 24 is constructed by forming a hollow cylinder from a piece of wire and then making two diametrical cuts 26 through the cylinder for a portion of the cylinder length, each cut being spaced 90° from the other thereby providing four fingers extending from the body portion of the insert. As may be appreciated from the drawing, fingers 25 of the prior art embodiment have a beam construction in that both their exterior and interior surfaces are laterally curved so that it is effectively prevented from flexing throughout its length. The cuts 26 are typically made to a depth of about two-thirds the length of insert 24 as shown in FIG. 3, and fingers 25 are then bent inwardly at point 27 in a mutually converging arrangement.

With reference to FIG. 4 it may be appreciated that with the curved beam configuration of contact 24, upon insertion of lead 28 extending from component 29, fingers 25 remain substantially rigid and most of the flexing takes place at bend point 27. Leads, such as lead 28, may have different shapes and sizes, being square, round or rectangular. Most such leads employed in pluggable panel boards, however, are of relatively flat rectangular configuration. The fingers ideally should flexibly and frictionally separate to engage the lead and provide positive electrical connection and physical retention. It may be seen that with the prior art configuration, significant stresses may occur at bend point 27 which could have adverse effect upon the proper functioning of the insert over an extended period of time.

Figure 5:
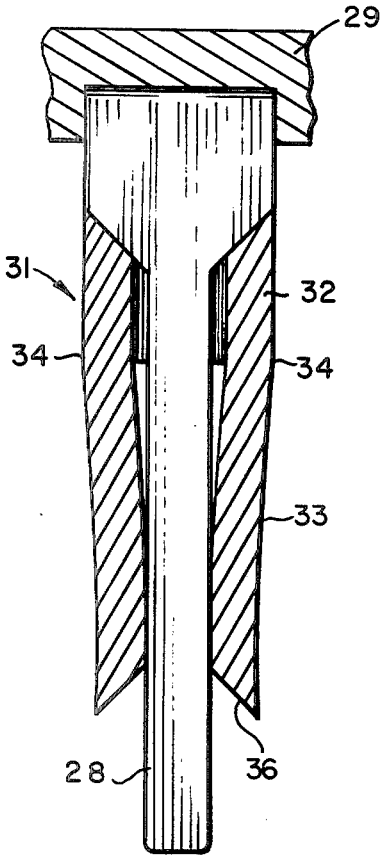
FIG. 5 is a view of the invention, similar to FIG. 4, with a component lead inserted.

The effect of the improved socket insert of this invention is shown in FIG. 5. Insert 31 is formed with body portion 32 and fingers 33 which converge from the body portion at bend point 34. With lead 28 inserted between fingers 33, a flexing takes place throughout their length as indicated in a somewhat exaggerated manner in the drawing. This flexing not only relieves the stresses previously encountered at the bend point, but where the fingers are forced relatively widely apart, some surface engagement is made between the lead 28 and fingers 33, thus improving both the physical and electrical contact.

Figure 6:
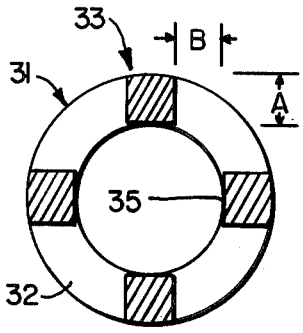
FIG. 6 is a view similar to FIG. 2 showing the structure of the fingers of the socket insert.

The insert of the present invention is formed as shown in FIG. 6, wherein the cylinder which is typically prepared in the manner previously discussed, has two parallel cuts extending in a direction parallel to the cylinder axis for a longitudinal distance which is preferably more than one half, and normally about two-thirds, the length of the cylinder. Each cut has its outer edge tangent to the internal surface 35 of the cylinder and is approximately the same width B as the thickness A of the cylinder wall. By making two sets of parallel cuts in this manner, each set being angularly spaced by 90°, fingers 33 having flat inner surfaces are formed. While the outer surfaces of these fingers are still somewhat curved, the beam effect prevalent in the prior art is significantly reduced. The result is four fingers which, when converged, are indeed flexible throughout their length, being somewhat stiffer than the rectangular fingers of stamped contacts, and more flexible than the fingers of prior art machined contacts. When a component lead is inserted between the fingers, as shown in FIG. 5, this flexibility is distributed from the distal ends 36 all the way back to the bend point 34 such that there are no excessive or deleterious stresses at any point along the length of the fingers.

With insert fingers having the configuration of FIGS. 5 and 6, it may be appreciated that component leads of any shape, including square, round or rectangular, may be inserted into the insert and be positively engaged, both physically and electrically, by the flexible converging fingers 33. However, it is particularly useful with square and rectangular leads because of the configuration of the mating surfaces between lead and fingers. Because the stresses resulting from the outward flexing of the fingers are distributed throughout their length, there is substantially no reduction in the flexiblity, or in the ability of the fingers to engage the component lead, with either age or extensive use. Additionally, because of the distributed flexibility of the fingers, the electrical lead insertion and removal forces involved in plugging into and unplugging components from the insert of this invention are relatively constant from device to device and with respect to the same insert over an extended period of time in use. This is also an improvement over stamped inserts whose final shape is more variable than prior art machined elements, thereby leading to variability of insertion and removal forces.

Figure 7:
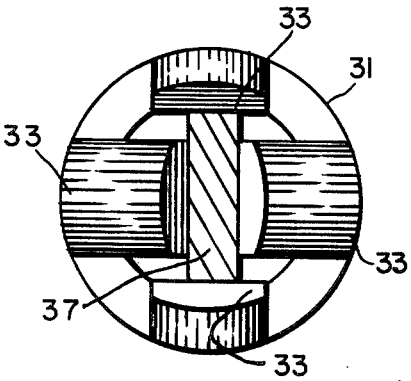
FIG. 7 is a bottom end view of the insert of FIG. 5 showing a rectangular component lead inserted between the converging fingers.

FIG. 7 shows the bottom of socket insert 31 with a rectangular component lead 37 inserted between inwardly biased fingers 33. These fingers may be prestressed in such a manner that when a lead of this configuration spreads two opposite fingers 33, the remaining two fingers essentially snap inwardly to engage the wider surfaces of the lead as shown. Thus the electrical and physical engagement of the lead by the fingers is not only maintained but enhanced by this invention. Of course, square and round leads are also effectively engaged by fingers 33 but this invention is especially suited to flat rectangular leads.

Figure 8:
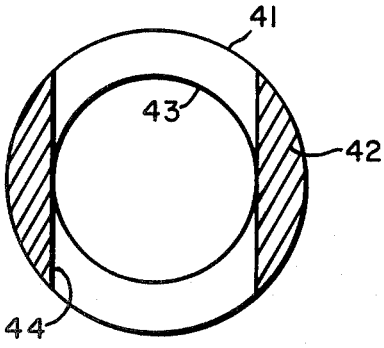
FIG. 8 is a view similar to FIG. 6 showing an alternative embodiment of the invention.

An alternative embodiment is shown in FIG. 8. Instead of making four tangential cuts to form the fingers of lead socket insert 31 as shown in FIG. 6, here a wider cutting blade makes only a single diametrical cut in insert 41 with both outer edges of the cut being tangential to inner cylindrical surface 43. This forms two fingers 42 having flat inner surfaces 44. When these fingers are bent inwardly they function in the same manner as do the four fingers of the FIG. 6 embodiment. The embodiment of FIG. 8 is suitable for use with round and square leads; it is also useful with rectangular leads when the socket insert is oriented with respect to the leads so that the flat surfaces of fingers 42 engage the flat sides of such leads.

Figure 9:
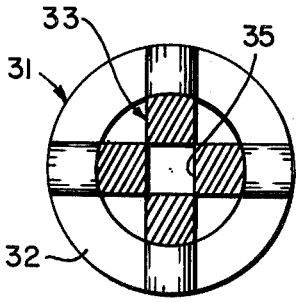
FIG. 9 is an end view of the embodiment of FIG. 6 showing the fingers biased together.
Figure 10:
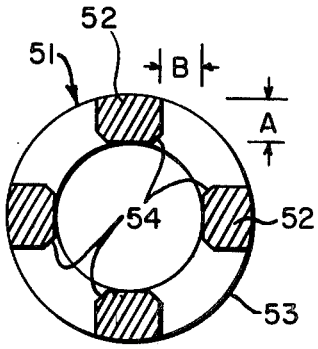
FIG. 10 is an end view similar to FIG. 6 showing a preferred embodiment of the invention.
Figure 11:
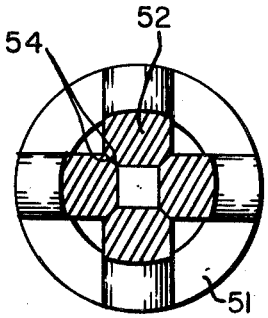
FIG. 11 is an end view of the embodiment of FIG. 10 showing the fingers biased together.

Another preferred embodiment is shown in FIGS. 10 and 11. In this case the width B of the cuts described with respect to FIG. 6 may be substantially less than the thickness A of the cylinder wall. This would leave a pie-shaped finger between each two fingers 52 extending from body 53 of insert 51. Another pair of cuts, displaced by 45° from the first four cuts, are made to remove the unwanted fingers and to simultaneously chamfer the inner edges 54 of each of fingers 52. This permits the fingers to be biased more closely together (compare FIG. 11 with FIG. 9), thereby enabling the fingers to firmly engage even smaller leads or provide an even more positive engagement with standard leads than would be possible with the embodiment of FIG. 6. By being able to converge fingers 52 as closely together as shown in FIG. 11, not only do they more firmly engage a component lead but greater surface contact will be achieved because of the distributed flexing of the fingers. Thus the flexing shown in FIG. 5 will be enhanced.

While fingers 52 in FIG. 10 are shown with their inner surfaces tangential with the inner surface of body member 51, they may be cut in such a way that they are thinner than the cylinder wall. By making the major cuts radially outwardly spaced from the inner surface, the stiffness of the fingers can be varied as desired.

It should be noted that although the lead socket insert of this invention has been generally described as one of the elements of a two-piece socket contact of the type shown in FIG. 1, this insert can also be force fitted directly into plated-through holes in panel boards for direct pluggable mounting of component leads therein.

For reference purposes, the size of typical lead socket inserts and the materials used in the manufacture thereof will be set forth. For the configuration shown in FIG. 1, the outer element comprising sleeve 12 and projection 14 is typically 0.563 inch (14.30 mm) long having an external major diameter of 0.072 inch (1.83 mm) at the top and a body diameter just above transition 13 of 0.053 inch (1.35 mm). The internal bore 15 of the sleeve is 0.0433 inch (1.10 mm) and the included angle of bevels 16 and 17 is typically 60°. The sleeve is normally made of brass. The insert 21 has a total length of 0.094 inch (2.39 mm) and a diameter slightly larger than the internal diameter of sleeve 12, that is, approximately 0.044 inch (1.12 mm). An example of the wall thickness of the insert is 0.009 inch (0.23 mm). The length of the cut from the tips of fingers 22, 25, 33 into the insert body is approximately 0.064 inch (1.63 mm) and the material of insert 21 is typically beryllium copper. Of course, other materials may be used which have a modulus of elasticity such that the fingers of the socket insert, which are anchored at one end, function as leaf springs. Components having different sizes may be made in the same manner.

In view of the above description, it is likely that others skilled in the art will devise modifications and improvements which are within the scope of the invention.

What is claimed is:

1. A socket contact comprising:

an elongated sleeve member formed with an internal bore opening into one end and a projection adapted for electrical interconnection by means such as soldering or wire wrapping extending from the other end, said bore being blind at one end and having a tapered entry at the open end; and a machined insert within said bore, said insert having a hollow body portion of generally cylindrical configuration with a tapered entry at one end aligned with and forming a continuation of said bore tapered entry, said body being integrally formed with a plurality of flexible fingers at the other end, each of said fingers having a substantially flat inner surface, said fingers being bent and biased inwardly at their point of connection with said body toward the axis of said insert thereby providing a converging configuration, said converging fingers being adapted to receive and frictionally engage an electrical component lead therebetween.

2. The socket contact recited in claim 1 wherein said insert has a through opening from said tapered entry to the distal ends of said flexible fingers.

3. The socket contact recited in claim 1 wherein said insert is formed of an electrically conductive material having a relatively high modulus of elasticity whereby said fingers function as leaf springs.

4. The socket contact recited in either of claims 1 or 3 wherein said flat inner surfaces of said fingers provide surface contact with a component lead inserted therebetween.

5. The socket contact recited in either of claims 1 or 3 wherein when a component lead is inserted between and forces said fingers apart, the flexing of said fingers is distributed throughout their length from their distal ends to said connection point.

6. The socket contact recited in claim 1 wherein said plurality of flexible fingers comprises two fingers having their flat surfaces in spaced confronting relationship.

7. The socket contact recited in claim 1 wherein said plurality of flexible fingers comprises four fingers arranged in two pairs, the flat surfaces of each pair being in spaced confronting relationship.

8. The socket contact recited in claim 7 wherein the inner corners of said fingers are chamfered, thereby increasing the inward biasing of said fingers.

9. A lead socket insert comprising:

a machined hollow cylindrical body portion having a tapered entry at one end; and a plurality of flexible fingers extending from the other end of said body portion, said fingers having a substantially flat inner surface and bending inwardly toward the axis of said socket from their point of connection with said body portion, the converging configuration of said flexible fingers being adapted to receive and frictionally engage an electrical component lead therebetween.

10. The lead socket insert of claim 9 wherein said plurality of flexible fingers comprises two fingers having their flat surfaces in spaced confronting relationship.

11. The lead socket insert of claim 9 wherein said insert is formed of an electrically conductive material having a relatively high modulus of elasticity whereby said fingers function as leaf springs.

12. The lead socket insert of either of claims 9 or 11 wherein said flat inner surfaces of said fingers provide surface contact with a component lead inserted therebetween.

13. The lead socket insert of either of claims 9 or 11 wherein when a component lead is inserted between and forces said fingers apart, the flexing of said fingers is distributed throughout their length from their distal ends to said connection point.

14. The lead socket insert of claim 9 wherein said plurality of flexible fingers comprises four fingers arranged in two pairs, the flat surfaces of each pair being in spaced confronting relationship.

15. The lead socket insert of claim 14 wherein the inner corners of said fingers are chamfered, thereby increasing the inward biasing of said fingers.

* * * * *